United States Patent [19]

Harding

[11] Patent Number: 4,569,099

[45] Date of Patent: Feb. 11, 1986

[54] PAINT ROLLER WASHING SHIELD

[76] Inventor: Henry W. Harding, 6610 Harwin, Houston, Tex. 77036

[21] Appl. No.: 564,488

[22] Filed: Dec. 22, 1983

[51] Int. Cl.[4] ..... B08B 13/00

[52] U.S. Cl. ..... 15/248 A; 15/230.11; 134/182

[58] Field of Search ..... 15/248 A, 230.11; 134/51, 138, 182; 68/213

[56] References Cited

U.S. PATENT DOCUMENTS

| | | | |
|---|---|---|---|
| 3,029,458 | 4/1962 | Balicki | 15/248 A X |
| 3,058,145 | 10/1962 | Hegedus | 15/248 A X |
| 3,175,241 | 3/1965 | Singelton et al. | 15/230.11 X |
| 3,538,532 | 11/1970 | Shortino et al. | 15/248 A X |
| 3,654,658 | 4/1972 | Kovacs | 15/230.11 X |
| 4,254,529 | 3/1981 | Cooke | 15/248 A X |

FOREIGN PATENT DOCUMENTS

| | | | |
|---|---|---|---|
| 478760 | 7/1926 | Fed. Rep. of Germany | 15/248 A |

*Primary Examiner*—Philip R. Coe
*Assistant Examiner*—Frankie L. Stinson
*Attorney, Agent, or Firm*—Ranseler O. Wyatt

[57] ABSTRACT

A paint roller washing shield having an arcuate shield and having a semi-cylindrical handle extending laterally therefrom in which the handle of a paint roller to be washed may be received and held tightly in place during the washing operation. The shield receives the paint roller with a portion of the roller extending outwardly from the shield, where it is exposed to a stream of water from a hose, the shield having a drip guard and the handle of the shield having means for accommodating several sizes of handles and the shield accepting several sizes and styles of paint rollers.

5 Claims, 3 Drawing Figures

PAINT ROLLER WASHING SHIELD

BACKGROUND OF THE INVENTION

The present method of washing paint rollers consists of applying a stream of water from a hose. This is extremely messy and the spray from the washing spreads paint and water over a considerable area. It is an object of this invention to provide a means for cleaning paint rollers, or applicators, which are saturated with water soluable paint, which will shield the user from the spray.

SUMMARY OF THE INVENTION

A paint roller washer having an arcuate shield formed of light, rigid, non-porous material and a rearwardly extending semi-cylindrical handle adapted to receive and tightly maintain the handle of the roller within the handle of the shield and to maintain that position as a stream of water is directed against the exposed portion of the roller.

DESCRIPTION OF THE PREFERRED EMBODIMENT

Figure 1:
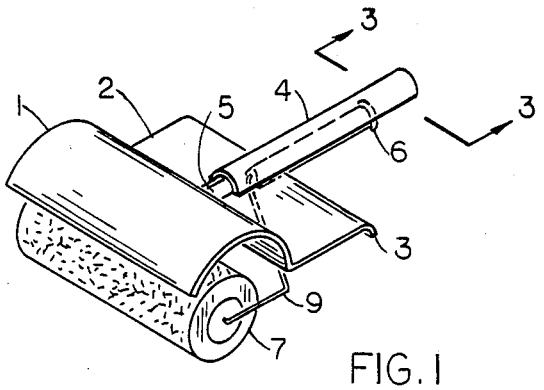
FIG. 1 is a perspective view of the shield mounted on a roller.
Figure 2:
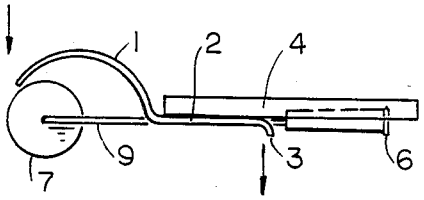
FIG. 2 is a side elevational view of the shield, with the roller attached.
Figure 3:
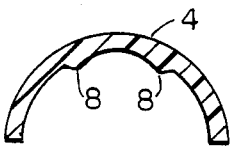
FIG. 3 is a cross sectional end view of the handle, taken on the line 3—3 of FIG. 1.

In the drawings, the numeral 1 designates an arcuate sheet, preferably of a molded plastic material having a rearwardly extending apron 2, and a downwardly extending lip on the extended end thereof. A handle 4, on the apron 3, is mounted over the slot 5 cut transversely in the apron 3, and is semi-cylindrical in shape, adapted to receive therein the handle 6 of a paint roller 7. There are several sizes of handles, so the inner wall of the handle 4 has the projecting ridges 8, to provide means for receiving all sizes of paint roller handles.

In use, the handle 6 of the paint roller is placed in the semi-cylindrical handle of the shield, and is gripped by the user to firmly hold the paint roller in position, adjusting the paint roller in the shield so that the roller extends slightly forward of the shield 1, then a spray of water is directed against the exposed portion of the roller, causing the roller to spin and washing the paint out of the roller. The roller may be held over a container, so that the wash water and paint will be captured for disposal. There are a number of styles and sizes of paint rollers, the supporting rod 9 sometimes being of a different shape than that shown, or being doubled, with a wire on each side. Any of these will fit in the shield handle 4, and washed in this device.

As the roller 7 is washed, water running back on the shield 1 and apron 2, will follow the curvature of the lip 3 and will fall in front of the user.

The handle 4 of the shield has projecting ridges 8 on the inner wall area to provide means for receiving any size of paint roller handle, the smaller handles abutting the ridges, and the larger handles abutting the lower areas of the inner wall of the paint holder handle 4.

The foregoing description of the invention is by way of illustration only, the broad principle of the invention being defined by the appended claims.

What I claim is:

1. In a paint roller washing shield for paint rollers having a rearwardly extending handle thereon, an arcuate rigid sheet of non-porous material, an apron extending rearwardly from said sheet, a downwardly turned lip on the extended end of said apron and an arcuate handle mounted on said apron midway its longitudinal ends, and extending rearwardly therefrom and formed to receive the said handle of a paint roller and the paint roller handle and the washing shield handle gripped simultaneously by the user's hand.

2. The device defined in claim 1 wherein said washing shield handle is arcuate to receive and fit over the handle of any paint roller.

3. The device defined in claim 1 wherein said apron has a transverse slot formed therein over which an arcuate handle having longitudinal inner and outer walls and kaving paint roller handle receiving means formed in the inner wall.

4. The device defined in claim 1 wherein said apron has a transverse slot formed therein over which the arcuate handle is positioned and through which the paint roller handle extends, the upper longitudinal portion of the inner wall of said arcuate handle having inwardly extended projections to cause a close fit with various paint roller handles in said arcuate handle.

5. A paint roller washing shield having an arcuate member of rigid non-porous material and an apron extending rearwardly therefrom with a downwardly turned lip on the extended end, said apron having a transverse slot therein over which an arcuate handle is mounted, all of said parts being molded to form a single homogenous mass and said arcuate handle being adapted to receive a paint roller handle and the washing shield handle and the paint roller handle gripped simultaneously by the user.

* * * * *